US008308463B2

(12) United States Patent
Kataoka et al.

(10) Patent No.: US 8,308,463 B2
(45) Date of Patent: Nov. 13, 2012

(54) RESIN SCREW ROTOR MOLDED TO A METALLIC SHAFT

(75) Inventors: Yasuto Kataoka, Kobe (JP); Naoki Kikuchi, Kobe (JP); Junichiro Totsuka, Hyogo (JP); Naoya Fujiwara, Kobe (JP)

(73) Assignee: Kabushiki Kaisha Kobe Seiko Sho, Hyogo (JP)

( * ) Notice: Subject to any disclaimer, the term of this patent is extended or adjusted under 35 U.S.C. 154(b) by 286 days.

(21) Appl. No.: 11/905,353

(22) Filed: Sep. 28, 2007

(65) Prior Publication Data

US 2008/0080996 A1 Apr. 3, 2008

(30) Foreign Application Priority Data

Sep. 28, 2006 (JP) ..... 2006-265208

(51) Int. Cl.

| | |
|---|---|
| ***F01C 1/08*** | (2006.01) |
| ***F01C 1/107*** | (2006.01) |
| ***F04C 18/16*** | (2006.01) |
| ***F04C 2/107*** | (2006.01) |

(52) U.S. Cl. ..... 418/191; 418/179; 418/201.1; 418/152; 418/153; 418/156

(58) Field of Classification Search ..... 418/191, 418/179, 152, 153, 156, 201.1
See application file for complete search history.

(56) References Cited

U.S. PATENT DOCUMENTS

| | | | | |
|---|---|---|---|---|
| 4,415,316 | A * | 11/1983 | Jurgens | 418/48 |
| 4,761,124 | A * | 8/1988 | Timuska et al. | 418/153 |
| 5,314,321 | A * | 5/1994 | Yamamoto et al. | 418/178 |
| 5,401,149 | A * | 3/1995 | Tsuru et al. | 418/179 |
| 5,419,217 | A * | 5/1995 | Umezawa et al. | 74/567 |
| 6,186,756 | B1 * | 2/2001 | Kojima et al. | 418/152 |

FOREIGN PATENT DOCUMENTS

| | | | |
|---|---|---|---|
| JP | 2645261 | | 5/1988 |
| JP | 01301976 | A * | 12/1989 |
| JP | 03290086 | A * | 12/1991 |
| JP | 06-123292 | | 4/1992 |
| JP | 06123293 | A * | 5/1994 |
| JP | 06280764 | A * | 10/1994 |
| JP | 09-264276 | | 3/1996 |

* cited by examiner

*Primary Examiner* — Mary A Davis
(74) *Attorney, Agent, or Firm* — Stites & Harbison, PLLC; Juan Carlos A. Marquez, Esq.

(57) ABSTRACT

The present invention is to provide a screw rotor including a resin rotor formed around a metallic shaft without generation of cracks. Spiral chamfers are formed on surfaces of metallic shafts around which resin rotors are formed. Preferably the surfaces of the shafts may be sandblasted, and after the surfaces of the shafts are preliminarily coated with resin and then the rotors may be molded.

11 Claims, 2 Drawing Sheets

RESIN SCREW ROTOR MOLDED TO A METALLIC SHAFT

BACKGROUND OF THE INVENTION

1. Field of the Invention

The present invention relates to a screw rotor including a resin rotor formed around a metallic shaft.

2. Description of the Related Art

In order to strongly fix the shaft to the rotor in a screw rotor including a resin rotor formed around a metallic shaft, Japanese Patent Laid-Open No. Hei6-123292 describes that spiral grooves are formed in the shaft. However, the groove formed in the shaft creates a difference in level on an inner surface of the rotor. Therefore, there is a problem that stress is concentrated on edge parts thereof and hence cracks are generated.

Japanese Patent No. 3701378 describes a screw rotor in which grooves having a cross section in a circular arc shape are formed in a shaft and adjacent grooves are connected by a non-angular and smooth mountainous shape curve.

By the shaft shape of Japanese Patent No. 3701378, it is possible to ease the concentration of stress on an inner surface of the rotor. However, it is not possible to form such a non-angular groove by a normal working machine such as a screwing machine and a multiple lathe. Therefore, there is a problem that a finish processing requires a manual work with taking a lot of time and cost.

Since the shaft shape of Japanese Patent No. 3701378 requires a back clearance for tools when the spiral grooves are processed, a diameter on both sides of a part in which the spiral grooves are formed is narrow. Therefore, there is a difference in level in the rotor at the part in which the diameter of the shaft is narrow, and hence there is a case where the stress in the axial direction at the time of forming the rotor and driving causes cracks in the rotor.

Further, a depth of the spiral grooves in the shaft shape of Japanese Patent No. 3701378 is described to have about 1% of a shaft diameter. For example, however, in a shaft having a diameter of 40 to 80 mm, a depth of the grooves is shallow with 0.4 to 0.8 mm. There is a problem that the spiral groove is worn away soon due to rotary torque at the time of driving, loads in the thrust direction and the radial direction, and shear stress caused by a difference in thermal expansion rate between the shaft and the rotor.

SUMMARY OF THE INVENTION

In consideration to the problems mentioned above, an object of the present invention is to provide a screw rotor including a resin rotor formed around a metallic shaft without generation of cracks.

In order to achieve the object above, according to the present invention, in a screw rotor including a resin rotor formed around a metallic shaft, a spiral chamfer is formed on a surface of the shaft.

According to this configuration, since the chamfer part functions as a key, it is possible to improve a fixing force between the shaft and the rotor and to resist stress generated at the time of forming, processing and driving. Since only the chamfer is formed on the shaft, there is no difference in level and unevenness on an inner surface of the rotor and the stress is not so concentrated, thereby cracks and fractures are not easily generated. Further, such a chamfer can be easily processed by a general working machine.

In the screw rotor according to the present invention, the surface of the shaft may be sandblasted.

According to this configuration, it is possible to enhance the adhesive property of the shaft to the resin so as to improve the durability of the screw rotor.

In the screw rotor according to the present invention, the surface of the shaft may be preliminarily coated with resin, and then the rotor is molded.

According to this configuration, by coating the shaft with a resin having good adhesive property to metals, it is possible to enhance the adhesive strength of the rotor so as to improve the durability of the screw rotor.

In the screw rotor according to the present invention, the chamfer may be formed directly below a tooth root part of the rotor.

According to this configuration, it is possible to increase thickness of the rotor at the tooth root part which is the thinnest part of the rotor so as to improve the durability of the screw rotor. Since a cross sectional shape becomes constant, efficiency in designing and manufacturing is good and quality of products is improved.

In the screw rotor according to the present invention, when forming the rotor, tensile load may be given to the shaft in the axial direction, and after hardening of the rotor, the tensile load may be removed.

According to this configuration, it is possible to give the compressive residual stress to the rotor due to shrinkage of the shaft by removing the tensile load, and ease the concentration of the tensile load of the rotor so as to improve the durability of the screw rotor.

In the screw rotor according to the present invention, when forming the rotor, the shaft may be made to a higher temperature than the resin, and after hardening of the rotor, the shaft may be made to a normal temperature again.

According to this configuration, it is possible to give the compressive residual stress to the rotor by shrinking the shaft after forming the rotor, and ease the concentration of the tensile load of the rotor so as to improve the durability of the screw rotor.

According to the present invention, since the spiral chamfer is formed on the shaft, it is possible to provide the screw rotor with high durability which is easily processed.

DESCRIPTION OF THE PREFERRED EMBODIMENTS

A description will be given of an embodiment of the present invention with reference to the drawings.

Figure 1:
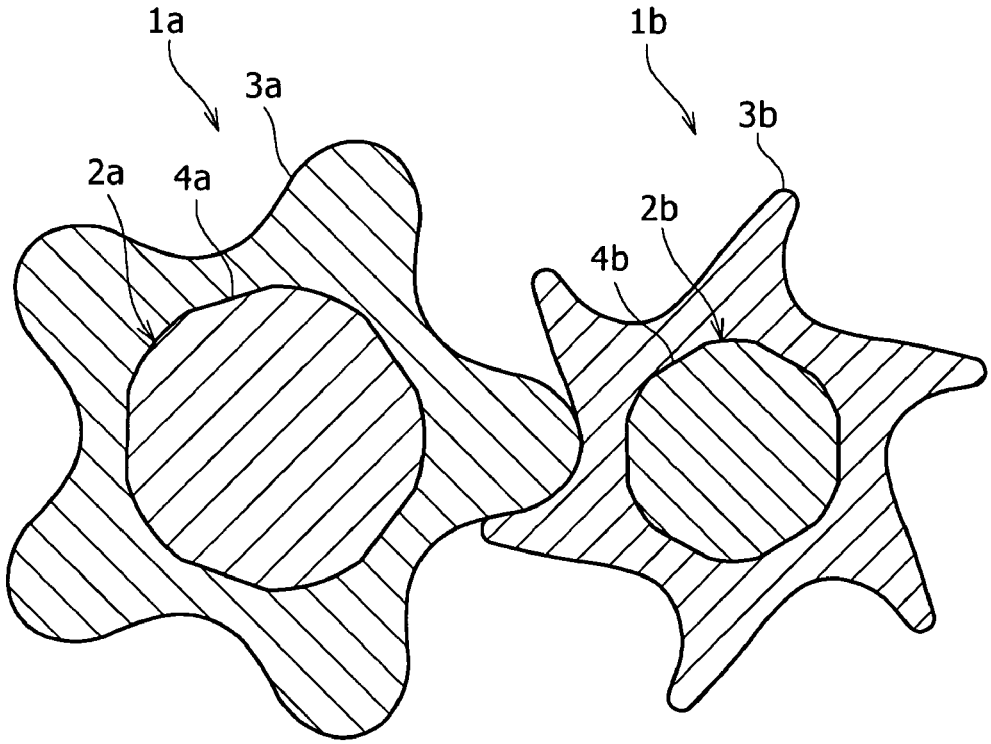
FIG. 1 is a cross sectional view of a screw rotor according to an embodiment of the present invention.

FIG. 1 shows a cross section of a screw rotor for compressor of an embodiment of the present invention. The screw rotor according to the present embodiment includes a pair of male rotor 1*a* and a female rotor 1*b*. Resin rotors 3*a* and 3*b* are molded around shafts 2*a* and 2*b* which are made of stainless steel SUS420F2 respectively for the male rotor 1*a* and the female rotor 1*b*.

The rotors 3*a* and 3*b* are molded in such a manner that the shafts 2*a* and 2*b* are arranged in molds, a resin such as epoxy resin is poured into the molds, the molds are heated for example to 150° C., and the resin is hardened. Since the resin preferably has a high strength, a high modulus and a dimensional stability, preferable examples of the resin are epoxy resin and urethane resin which include silica fillers or glass fibers as a reinforcing material.

The shaft 2*a* of the male rotor 1*a* according to the present embodiment has a diameter of 76 mm, and the rotor 3*a* having an outer diameter of 154.4 mm and a length of 248.6 mm is a left hand five teeth rotor. Meanwhile, the shaft 2*b* of the female rotor 1*b* has a diameter of 54 mm and the rotor 3*b* having an outer diameter of 132.2 mm and a length of 243.6 mm is a right hand six teeth rotor.

Figure 2:
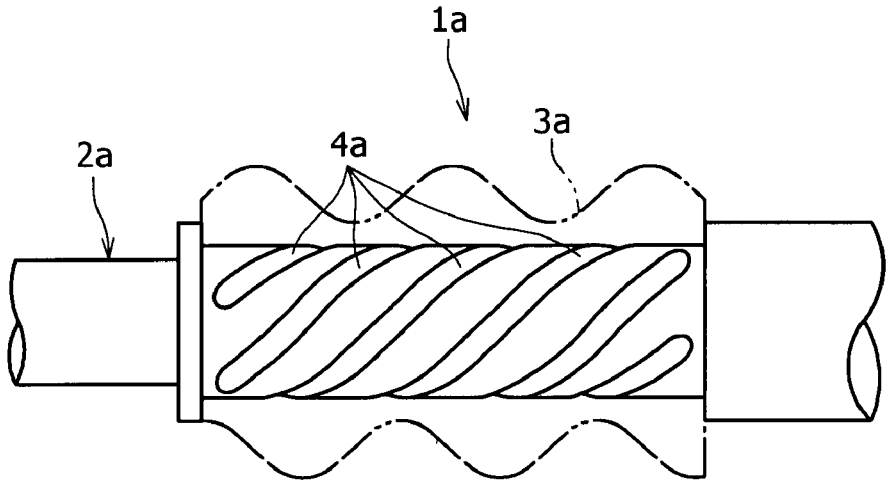
FIG. 2 is a plan view of a shaft of a male rotor in FIG. 1.
Figure 3:
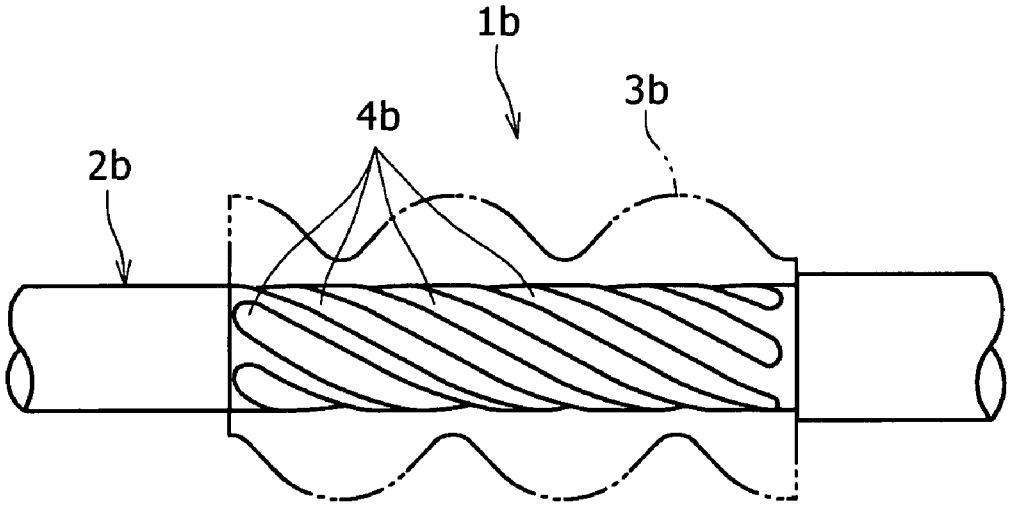
FIG. 3 is a plan view of a shaft of a female rotor in FIG. 1.
Figure 4:
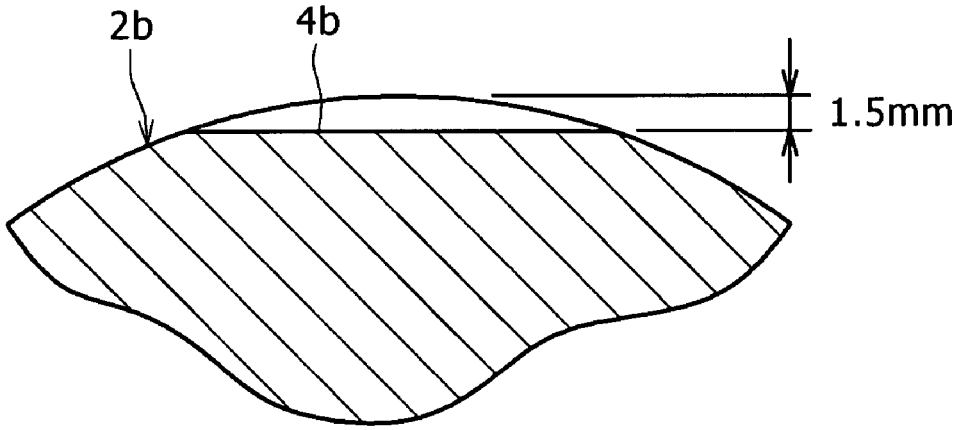
FIG. 4 is a partially enlarged cross sectional view of the shaft of the female rotor in FIG. 3.

Further, as shown in FIGS. 2 and 3, spiral chamfers 4*a* and 4*b* are formed on the shafts 2*a* and 2*b* respectively so as to extend directly below tooth root parts of the rotors 3*a* and 3*b*. As the female rotor 1*b* representatively shown in detail in FIG. 4, the chamfers 4*a* and 4*b* are formed by flatly cutting the shafts 2*a* and 2*b* by a depth of 1.5 mm (2% and 1.1% of the shaft diameters). The chamfer 4*a* is formed as five streaks and the chamfer 4*b* is formed as six streaks in correspondence with the number of tooth.

Such chamfers 4*a* and 4*b* can be easily formed by placing a plane milling cutter at right angles to the shafts 2*a* and 2*b*, and then cutting the shafts 2*a* and 2*b* on a multiple lathe for example.

In the male rotor 1*a* and the female rotor 1*b* which are formed as above, since the chamfers 4*a* and 4*b* play a role of key, a fixing force between the shafts 2*a* and 2*b* and the rotors 3*a* and 3*b* is strong so as to bear a high torque.

An angle between the chamfers 4*a* and 4*b* and outer peripheral surfaces of the shafts 2*a* and 2*b* is very obtuse. Therefore, there is no difference in level formed on inner surfaces of the rotors 3*a* and 3*b*, stress is only slightly concentrated and cracks are not easily generated in the rotors 3*a* and 3*b*.

When the rotors 3*a* and 3*b* are formed after surfaces of the shafts 2*a* and 2*b* according to the present embodiment axe sandblasted, it is possible to further improve the fixing force between the shafts 2*a* and 2*b* and the rotors 3*a* and 3*b*.

According to the present embodiment, the surfaces of the shafts 2*a* and 2*b* are coated with a resin having good adhesive property to metals such as Araldite, the rotors 3*a* and 3*b* are arranged in molds and a resin is poured into so as to form the rotors 3*a* and 3*b*. Subsequently, both of the resin (the coated resin and the poured resin) are hardened by heating. The resin coated over the surfaces of the shafts 2*a* and 2*b* enhances the fixing force between the shafts 2*a* and 2*b* and the rotors 3*a* and 3*b* and the rotors 3*a* and 3*b* are not easily separated from the shafts 2*a* and 2*b*.

The present invention may use an epoxy resin as the coated resin over the surfaces of the shafts since it has a good adhesive property to metals. Examples of preferable epoxy resin include bisphenol A epoxy resin, urethane modified epoxy resin and rubber modified epoxy resin which are thermosetted by hardening agent such as polyamide, polyaminoamide, aliphatic polyamine, alicyclic polyamine, aromatic polyamine and acid anhydride.

It can be thought that the rotors 3*a* and 3*b* are molded by urethane resin or the like having less adhesive property to metals than epoxy resin. In this case, it is more effective to mold the rotors 3*a* and 3*b* after preliminarily coating the surfaces of the shafts 2*a* and 2*b* with the resin.

In a state that the tensile stress is given to the shafts 2*a* and 2*b* according to the present embodiment, the rotors 3*a* and 3*b* are formed with resin around the shafts, and the tensile stress to the shafts 2*a* and 2*b* is removed after the rotors 3*a* and 3*b* are hardened. Consequently, it is possible to give the compressive stress to the rotors 3*a* and 3*b* at the normal time by shrinkage of the shafts 2*a* and 2*b*.

At the time of driving the screw rotor, the acting tensile stress facilitates the generation of cracks on the inner side of the rotors 3*a* and 3*b*. However, by preliminarily giving the compressive stress to the rotors 3*a* and 3*b*, it is possible to ease the substantially acting tensile stress so as to suppress the generation of cracks.

Such compressive stress can also be given by heating the shafts 2*a* and 2*b* and arranging the shafts in the molds in a state of thermal expansion, charging the resin around the shafts so as to mold the rotors 3*a* and 3*b*, and cooling the shafts 2*a* and 2*b* after hardening of the rotors 3*a* and 3*b*.

On the basis of the above embodiment, the following screw rotors are manufactured as experimental examples and comparative examples, and the strength thereof are tested.

Experimental Example 1

The male rotor 1*a* and the female rotor 1*b* are manufactured as an experimental example 1.

Experimental Example 2

An experimental example 2 is formed in such a manner that the rotors 3*a* and 3*b* are molded after the surfaces of the shafts 2*a* and 2*b* are sandblasted.

Experimental Example 3

An experimental example 3 is formed in such a manner that the rotors 3*a* and 3*b* are molded by the surfaces of the shafts 2*a* and 2*b* are coated with Araldite resin.

Experimental Example 4

An experimental example 4 is formed in such a manner that the rotors 3*a* and 3*b* are molded in a state that the tensile load of about 10 kgf/mm$^2$ is given to the shafts 2*a* and 2*b*.

Experimental Example 5

An experimental example 5 is formed in such a manner that the rotors 3*a* and 3*b* are molded after heating the shafts 2*a* and 2*b* to 300° C. and arranging the shafts in the molds. It should be noted that the time required for the hardening of the rotors 3*a* and 3*b* is about one hour, and a temperature of the shafts 2*a* and 2*b* at the time when the resin of the rotors 3*a* and 3*b* is hardened is about 200° C.

Comparative Example 1

A comparative example 1 is formed in such a manner that spiral grooves as described in Japanese Patent Laid-Open No. Hei6-123292 are formed in shafts having the same diameters as the shafts 2*a* and 2*b* and the rotors 3*a* and 3*b* are molded around the shafts.

Comparative Example 2

A comparative example 2 is formed in such a manner that spiral grooves whose cross sections are connected by a smooth curve as described in Japanese Patent No. 3701378 are formed in shafts having the same diameters as the shafts 2*a* and 2*b* and the rotors 3*a* and 3*b* are molded around the shafts.

The experimental examples and the comparative examples mentioned above are manufactured. In the comparative example 1, at the stage where the rotors 3*a* and 3*b* are hardened, the cracks are already generated on the surfaces of the rotors 3*a* and 3*b*.

With regard to the remaining experimental examples 1 to 5 and comparative example 2, when appearance thereof is observed again after the screw rotor is built in the compressor and driven for one mouth, the cracks are generated on an upper part of the difference in level for back clearance of cutters of both ends in the rotors 3*a* and 3*b* of the comparative example 2.

Since no damage is observed in the experimental examples 1 to 5, the screw rotors thereof are built in the compressor and driven for a total of six months. Even after that, however, no damage is observed and the performance of the compressor is not lowered.

Therefore, a high torque is given to the screw rotors of the experimental examples 1 to 5 until fractures are generated so as to measure a fracture torque and obtain the following results.

TABLE 1

| Sample | Fracture torque (kgf · m) |
|---|---|
| Experimental Example 1 | 256 |
| Experimental Example 2 | 290 |
| Experimental Example 3 | 302 |
| Experimental Example 4 | 277 |
| Experimental Example 5 | 273 |

Normally, the torque given to the screw rotors 1*a* and 1*b* is about 100 kgf·m at most. Therefore, the above fracture torque shows that each of the experimental examples has a sufficient bearing force.

In the experimental examples 2 to 5, the fracture torque is improved in comparison to the experimental example 1. Therefore, it is confirmed that production processes added to the experimental example 1 contribute to the improvement of the bearing force of the screw rotors 1*a* and 1*b*.

What is claimed is:

1. A screw rotor comprising a resin screw rotor molded onto a metallic shaft having a longitudinal axis, a plurality of spiral chamfers being formed on a longitudinal surface of said metallic shaft, wherein the spiral chamfers in a cross-section of the metallic shaft, perpendicular to the longitudinal axis, comprises a plurality of chords.

2. The screw rotor according to claim 1, wherein the surface of said metallic shaft is sandblasted.

3. The screw rotor according to claim 1, wherein the surface of said metallic shaft is preliminarily coated with resin and hardened, and then said resin screw rotor is molded.

4. The screw rotor according to claim 1, wherein at least one of said spiral chamfers is formed directly below a tooth root part of said resin screw rotor.

5. The screw rotor according to claim 1, wherein when forming said resin screw rotor, tensile load is given to said metallic shaft in the axial direction, and after hardening of said resin screw rotor, said tensile load is removed.

6. The screw rotor according to claim 1, wherein when forming said resin screw rotor, said metallic shaft is made to a higher temperature than the resin, and after hardening of said resin screw rotor, said metallic shaft is made to a normal temperature again.

7. A screw rotor comprising:

a metallic shaft having a longitudinal axis, a plurality of spiral chamfers being formed on a longitudinal surface of said metallic shaft, wherein the spiral chamfers in a cross-section of the metallic shaft, perpendicular to the longitudinal axis, comprises a plurality of chords; and a resin screw rotor molded onto the metallic shaft, said resin screw rotor forming a plurality of teeth extending in a radial direction away from the metallic shaft, at least one root defined by the plurality of teeth being disposed directly above one of the spiral chamfers formed in the metallic shaft.

8. A screw rotor comprising:

a first metallic shaft having a longitudinal axis, a plurality of spiral chamfers being formed on a longitudinal surface of said first metallic shaft, wherein the plurality of spiral chamfers in a cross-section of the first metallic shaft, perpendicular to the longitudinal axis, comprises a plurality of chords;

a first resin screw rotor molded onto the first metallic shaft, said first resin screw rotor forming a plurality of first resin screw teeth extending in a radial direction away from the first metallic shaft; and a second resin screw rotor molded onto a second metallic shaft, forming a plurality of second resin screw teeth complementary to the plurality of first resin screw teeth formed on the first metallic shaft, wherein said plurality of first resin screw teeth from the first metallic shaft mate with the complementary plurality of second resin screw teeth on the second metallic shaft.

9. The screw rotor of claim 8, wherein at least one root defined by the plurality of first resin screw teeth of the first metallic shaft is disposed directly above one of the spiral chamfers formed in the first metallic shaft.

10. The screw rotor of claim 9, wherein:

the second metallic shaft has a longitudinal axis and a plurality of second spiral chamfers are formed on a longitudinal surface of said second metallic shaft, wherein the second spiral chamfers in a cross-section of the second metallic shaft, perpendicular to the longitudinal axis, comprises a plurality of second chords; and at least one root defined by the plurality of second resin screw teeth of the second metallic shaft is disposed directly above one of the second spiral chamfers formed in the second metallic shaft.

11. The screw rotor of claim 8, wherein:

the second metallic shaft has a longitudinal axis and a plurality of second spiral chamfers are formed on a longitudinal surface of said second metallic shaft, wherein the second spiral chamfers in a cross-section of the second metallic shaft, perpendicular to the longitudinal axis, comprises a plurality of second chords; and at least one root defined by the plurality of second resin screw teeth of the second metallic shaft is disposed directly above one of the plurality of second spiral chamfers formed in the second metallic shaft.

* * * * *